US007063087B2

(12) United States Patent
Cerbini et al.

(10) Patent No.: US 7,063,087 B2
(45) Date of Patent: Jun. 20, 2006

(54) FILTERING SYSTEM FOR THE PROTECTION AGAINST BIOLOGICAL AGENTS

(75) Inventors: Stefano Cerbini, Pesaro (IT); Pasqualino Lo Ioco, Cesena (IT)

(73) Assignee: CL. COM SRL, Forli (IT)

( * ) Notice: Subject to any disclaimer, the term of this patent is extended or adjusted under 35 U.S.C. 154(b) by 14 days.

(21) Appl. No.: 10/495,785

(22) PCT Filed: Nov. 12, 2002

(86) PCT No.: PCT/IT02/00718

§ 371 (c)(1),
(2), (4) Date: May 17, 2004

(87) PCT Pub. No.: WO03/041801

PCT Pub. Date: May 22, 2003

(65) Prior Publication Data

US 2005/0034728 A1 Feb. 17, 2005

(30) Foreign Application Priority Data

Nov. 15, 2001 (IT) ..... PSA000028

(51) Int. Cl.
*A62B 18/08* (2006.01)
*A62B 7/10* (2006.01)

(52) U.S. Cl. ..... 128/206.17; 128/206.12; 128/205.29; 128/205.27

(58) Field of Classification Search ..... 128/206.24, 128/206.12, 205.27, 206.15, 205.29, 206.17
See application file for complete search history.

(56) References Cited

U.S. PATENT DOCUMENTS

| | | | | | |
|---|---|---|---|---|---|
| 4,595,003 | A | | 6/1986 | Shoemaker et al. | 128/201.19 |
| 4,771,770 | A | | 9/1988 | Artemenko et al. | 128/201.13 |
| 4,945,574 | A | * | 8/1990 | Dagher | 2/9 |
| 5,140,980 | A | * | 8/1992 | Haughey et al. | 128/201.25 |
| 5,224,473 | A | * | 7/1993 | Bloomfield | 128/201.19 |
| H1360 | H | * | 10/1994 | Grove et al. | 128/201.25 |
| H1361 | H | * | 10/1994 | Tardiff, Jr. et al. | 128/206.12 |
| 5,829,428 | A | * | 11/1998 | Walters et al. | 128/200.24 |
| 6,062,220 | A | * | 5/2000 | Whitaker et al. | 128/206.19 |
| 6,155,432 | A | * | 12/2000 | Wilson et al. | 210/505 |
| 6,176,239 | B1 | * | 1/2001 | Grove et al. | 128/206.24 |
| 6,371,116 | B1 | * | 4/2002 | Resnick | 128/206.24 |
| 6,382,206 | B1 | * | 5/2002 | Palazzotto et al. | 128/201.19 |
| 2001/0008915 | A1 | * | 7/2001 | Hirata et al. | 524/423 |
| 2001/0029950 | A1 | * | 10/2001 | Haubeil | 128/205.13 |
| 2004/0025879 | A1 | * | 2/2004 | Wang et al. | 128/205.29 |

* cited by examiner

*Primary Examiner*—Henry Bennett
*Assistant Examiner*—Andrew Bunin
(74) *Attorney, Agent, or Firm*—Young & Thompson

(57) ABSTRACT

The invention refers to a filtering system composed by a face mask and a filter against biological agents, joined together by a new connector. The connector joins the filter to the mask in an easy, fast and affective way. The filtering system provides a very high barrier against biological agents, a high seal and is very easy to use.

17 Claims, 3 Drawing Sheets

FILTERING SYSTEM FOR THE PROTECTION AGAINST BIOLOGICAL AGENTS

FIELD OF THE INVENTION

Figure 2:
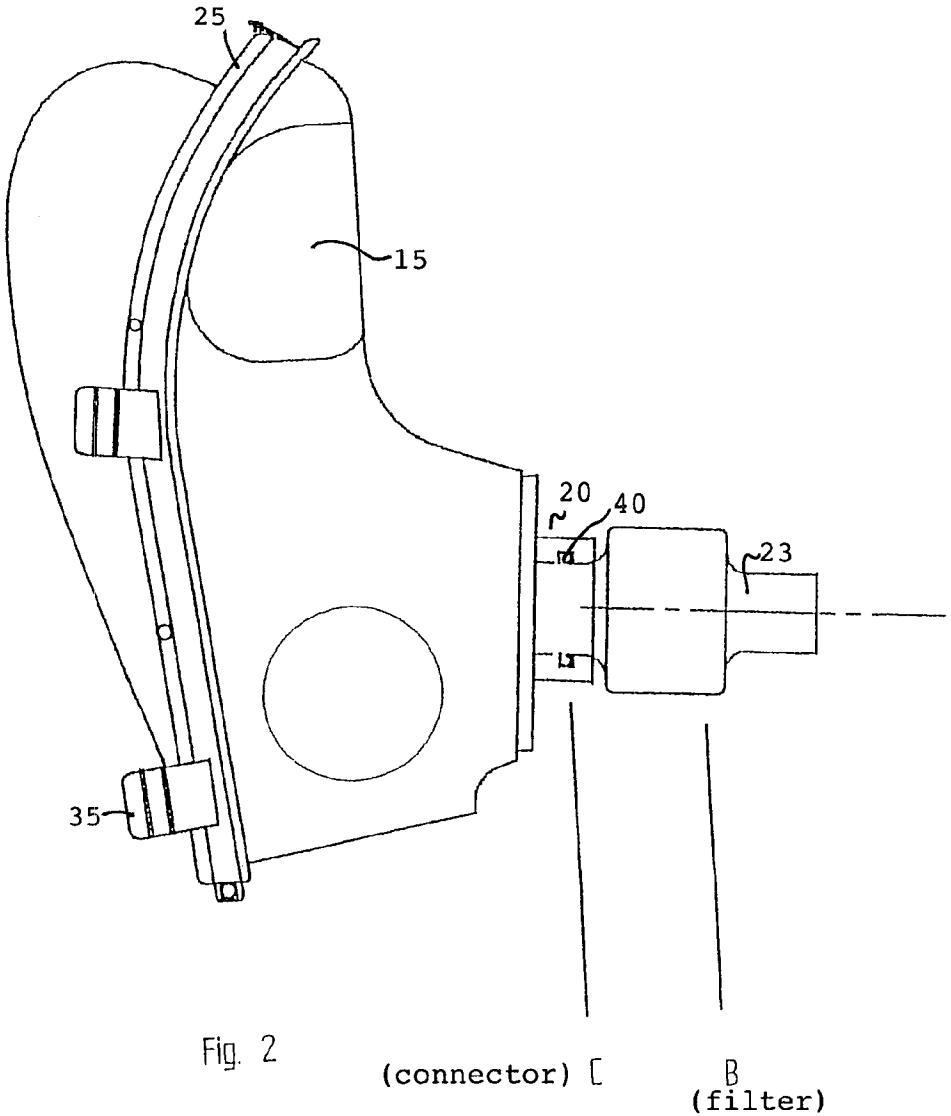

The present invention refers to a filtering system composed by a face mask and a filter against biological agents, joined together by a new connector.

PRIOR ART

There are several situation where workers are exposed to infective biological agents, that is micro-organisms, including those which have been genetically modified, which may be able to provoke infection, allergy or toxicity.

In some work situations, e.g. microbiological laboratories and biotechnological productions the infective agents are usually well known.

In other types of work, the agents the workers are exposed may not be known and only possible risks can be assessed; this happens, for example, in agriculture work, waste treatment, in particular hospital waste, veterinary laboratories, emergency clean-up.

In all these circustances, the use of protective means is strictly necessary. In particular, protection masks are widely used in any situation in which it is necessary to guarantee the user's protection from the viral trasmission by air.

Several kind of protective masks have been described, for example in EP 0459123 B1 (priority DE 4017336), EP 0511592 A1 (priority IT MI911172), EP 0511593 B2 (priority IT MI911171) and IT 1045644.

These masks ensure the user's protection from gases, powders and against chemical agents.

In many activities is required the protection against biological agents, for example in hospital and veterinary environments.

For example, the protection against biological agents is important in anaesthetic systems which can be easily contaminated by bacteria thereby increasing the risk of transmission to subsequent patients.

There are several studies on the problem of cross infection by anaesthetic breathing systems (see, for example, "Circuiti per anestesia e infezione crociata"—D. T. M. Leijten, R. P. Mouton, V. S. Rejger-Incontro di aagiornamento A.A.R.O.I.—Arezzo 1991).

In order to protect the anaesthetic system from contamination as well as the patient from the contaminated apparatus, the most efficient way is the air filtration.

Filters for this aim are described, for example, in "Bacteria Removal of the Pall Ultipor Breathing System Filter"—M. J. Latham Ph. D., Scientific and Laboratory Services, Pall Europe Limited.

In other situations aqualungs are used as protective devices against biological agents.

Aqualungs have a very high efficiency but show some disadvantages, owing to their dimensions with relevant hindrance and troubles in uncomfortable situations like in emergengy works.

Consequently, there was the need of finding a filtering system which, besides ensuring an effective barrier against biological agents, was easy and comfortable for using in any situation.

SUMMARY

The present invention refers to a filtering system composed by a face mask and a filter against biological agents, joined together by a new connector.

The filtering system has high barrier properties against biological agents, high seal and is very easy to use.

DESCRIPTION OF THE INVENTION

The new filtering system consists of:

A) a protection face mask

B) a filter against biological agents

C) a connector useful to easily, quickly and efficaciously join the filter to the mask.

Figure 1:
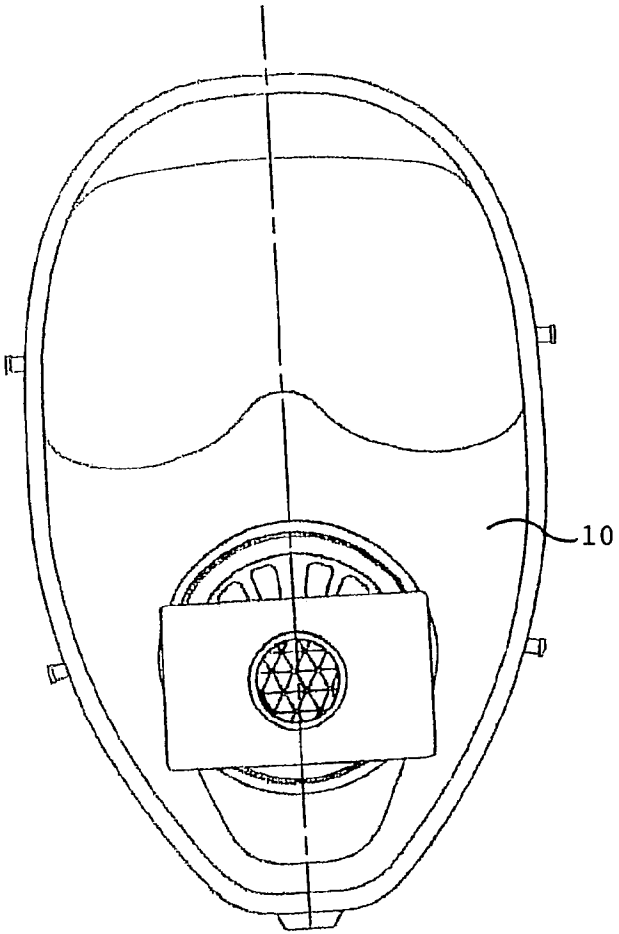

FIGS. 1 and 2 represent, respectively, the front and side view of the filtering system.

In FIG. 2, the filter is indicated by letter B while the connector is marked by letter C.

The mask is a protective mask complying with the existing rules, in particular with EN 136:98, class 3, and Directive 89/686/CEE and subsequent modifications.

The mask comprises a plastic face-piece, typically a butylic rubber or silicone face-piece, a transparent plastic screen 15, for example a polycarbonate screen, capable of permitting the user's vision and a plastic group 20 containing the breathing means 23 to put the inner part of the mask into communication with additional filters or aqualung, expiration valves, inspiration valves and phonic means (not illustrated). The breathing means 23 allows connection to external components. O-ring 40 provides a sealing and blocking function discussed below.

The face-piece is provided with a sealing lip 25 arranged to act in abutment on the user's face and two valves providing the air circulation to prevent the screen from tarnishing.

The mask is equipped with buckles 35 for fast and easy fastening.

The mask is equipped with a sleeve having standard threadings, usable with all the breathing systems equipped with EN 148-1-DIN 3183 connector, which allows the use of typical filters against gases, powders and chemicals, the use of oxygen closed-circuit breathing apparatus as well as the use in overpressure conditions.

The filter for the protection against biological agents is a single-use filter consisting in a pleated membrane made of ceramic microfibers, with high efficiency as barrier against bacteriae and viruses.

The filter is put inside a transparent plastic container, for example a polypropylene, butadiene-styrene or EVA-polycarbonate copolymer container, having controlled seal and blunted corners.

Figure 4:
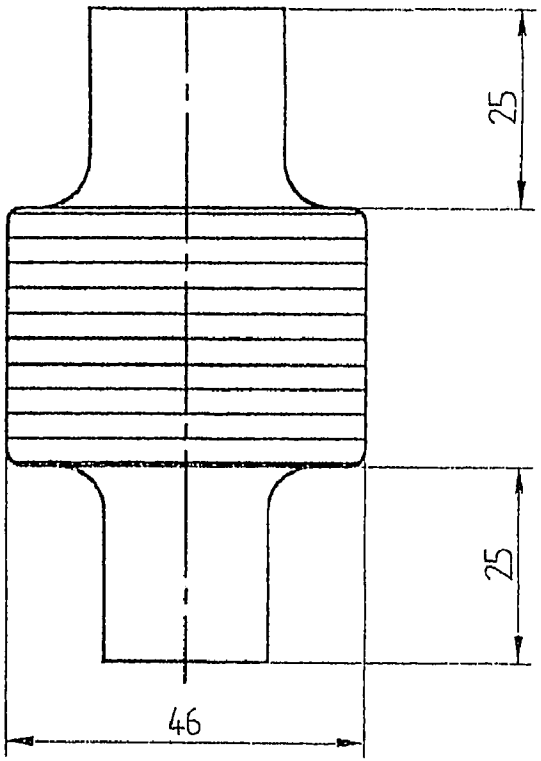
Figure 3:
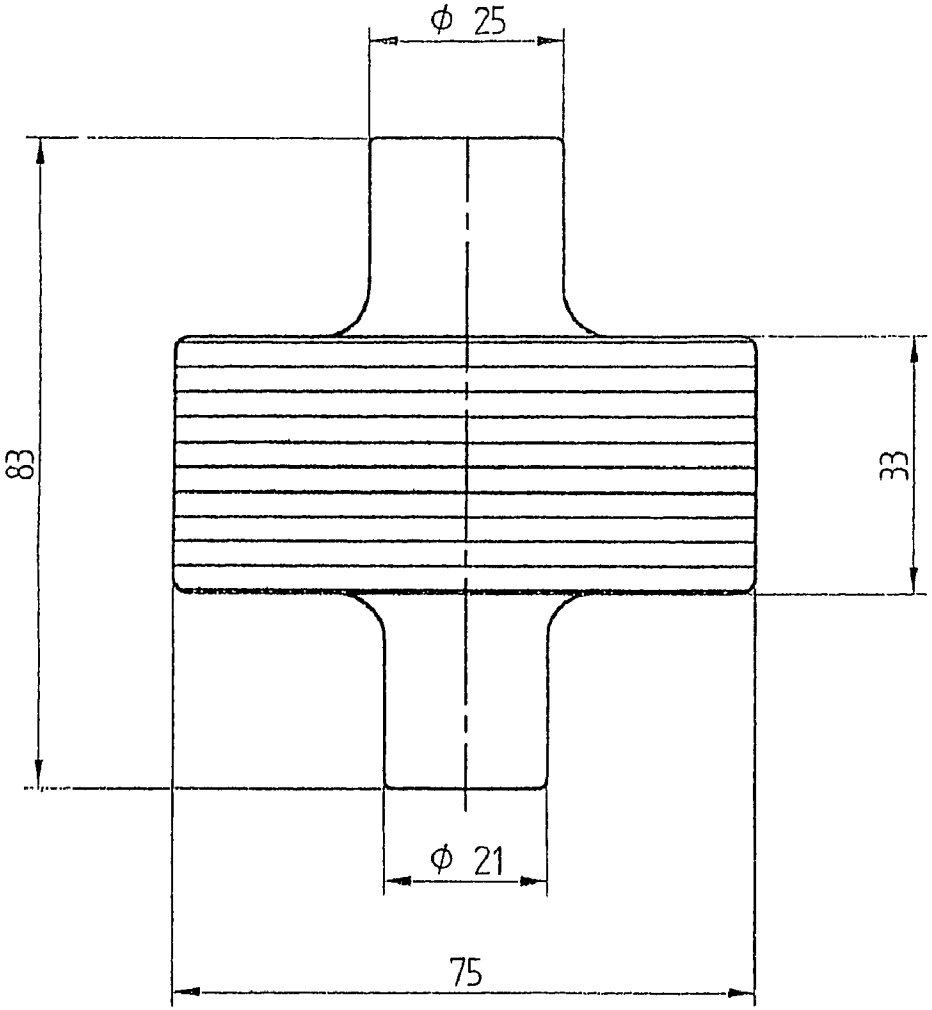

FIGS. 3 and 4 represent the filter with the relevant dimensions in mm.

Furthermore the position of the membrane inside the filter is also shown. The membrane is hydrophobic (liquid-tigth) on the worker side, avoiding the penetration of liquids with surface tension>70 dine/cm, and is hydrophilic on the environment side, in order to ensure an high humidification yield.

The moisture resistance, at 60 l/min, is <2.5 cm $H_2O$ and the loose of moisture in the expiration phase is less than 8 mg/l.

The filter also provides an high heat recovery from the gases during the inspiratory phase.

The filtering area is 700 $cm^2$ while the overall exchange surface is more than 10 $m^2$.

The weigth of the filter ranges between 44 and 50 g. and the volume ranges between 80 and 90 ml.

The filter described as above and used in the filtering apparatus of the present invention, is a known system widely used in the sanitary field in the breathing circuits in order to provide a total barrier to the penetration of viruses and bacteria which can be transmitted by gases and liquids, such as contaminated body fluids.

It is consequently equipped with connectors for the use in standard sanitary apparatus, for example with connector 22/15 M/F complying with the standard ISO 5356-1 and 5356-2.

In addition, the connector for Luer-lock monitoring, complying with the standard ISO 594-2, can also be mounted.

The filter was not constructed and never applied for the use in combination with protection devices such as face masks.

Figure 6:
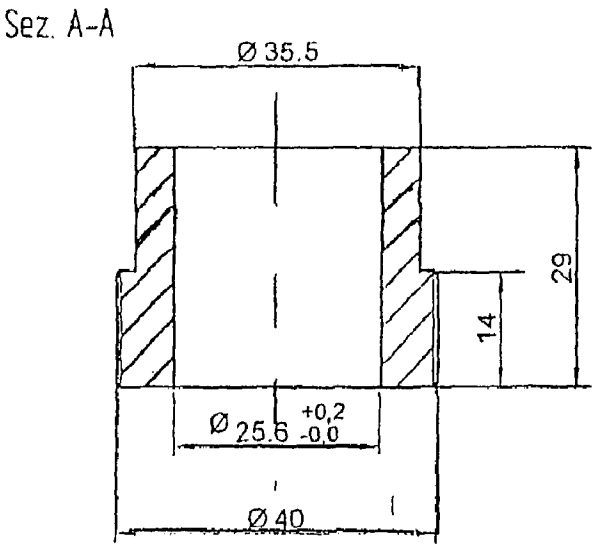
Figure 5:
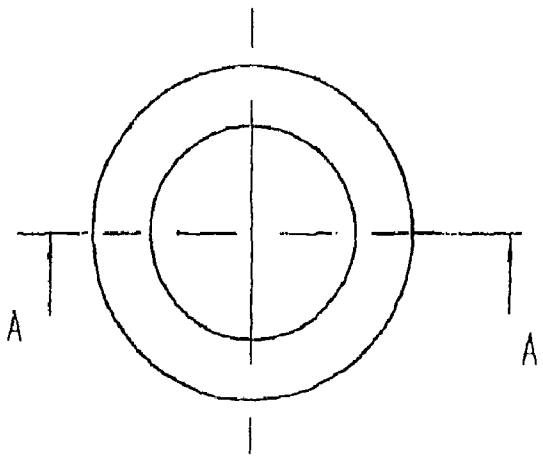

The connector (FIGS. 5 and 6) consists in a cylinder having, on the mask side, external diameter equal to 40 mm and the appropriate threading to screw it on the mask.

The external diameter of the filter side is 35.5 mm while the internal diameter is 25.6 (+0.2/−0.0) mm.

The cylinder is made of plastic material, in particular of a polyacetalic copolymer containing glass fibers.

The inside wall of the connector has a circular drill, at a 5 mm distance from the edge (filter side), 4 mm wide and 2.4 mm deep, in which an O-ring is inserted with blocking and sealing function.

The ring can be produced with different mixtures, for example with fluoro, silicone, ethylene-propylene or nitrile based mixtures, preferably with nitrilic mixture.

The connector can be applied on the mask by screwing and, on its turn, ensures the fast and easy application of the filter by simple pressure.

The filter can also be previously assembled with the connector in order to allow a faster application to the face mask; in this case the O-ring is not necessary and the assemblage can be achieved by known technologies as, for example, the use of suitable glues.

The system, thanks to the combination of the barrier properties of the filter with the tigth seal of the mask and the connectors, provides an efficient protection against the biological agents.

The efficacy of the pleated filter as a barrier to bacteriae and viruses have been widely investigated by tests with microorganisms containing aerosols and with liquids contaminated by bacteriae and viruses.

In particular, the filter turned out to be effective in preventing contamination with Hepatitis C Virus (HCV), Hepatitis B Virus (HBV), Human Immunodeficiency Viruses (HIV), Sp. Pseudomonas, Staphylococcus aureus, Serratia Marcescescens, Mycobacterium Tuberculosis and Virus MS2 (bacteriophage).

The details of the main known tests can be found in the following publications:

"efficacy of a pleated hydrophobic filter as a barrier to Hepatitis C transmission within breathing systems" (G. Lioyd, J. Howells, J. Benbough—Centre for Applied Microbiology & Research— Porton Down, Salisbury, Wiltshire SP4 OJG, UK);

"efficacy of a pleated hydrophobic filter as a barrier to human immunodeficiency virus transmission within breathing systems" (G. Lioyd, J. Howells—Centre for Applied Microbiology & Research—Porton Down, Salisbury, Wiltshire SP4 OJG, UK);

"efficacia di un filtro idrofobico con membrana pieghettata quale barriera alla trasmissione del Mycobacterium Tuberculosis nei sistemi di ventilazione artificiale" (S. Speigth, A. M. Bennet, M. R. Lever, J. Benbough—Centre for Applied Microbiology & Research—Porton Down, Salisbury, Wiltshire SP4 OJG, UK).

In all the above tests the filter efficiency turned out to be superior to 99.9999%.

In addition, the barrier efficacy of the filter has been demonstrated with an aerosol of monodispersed bacteriophage MS-2 (Viral removal efficiency of the Pall Ultipor Breathing System filter—P. R. Ball, D. Saunders—Bsc. Scientific and Laboratory services Pall Europe Limited).

MS-2 is a polyhedric virus with approximate dimension 0.02 microns, which is not pathogenic to humans and serves to simulate viruses, with similar shape and dimensions, that are pathogenic to humans.

Also in this case, the efficiency of the filter turned out to be superior to 99.999%.

It is worth mentioning that the test was carried out with monodispersed particles, that represents the most critical situation, in normal conditions the majority of microorganisms are not monodispersed but, on the contrary, they are in a wide variety of drop forms and of single microorganisms, so that the efficiency in normal condition of use may be even superior to the tests' results.

Consequently the filter is effective against any microorganism with dimension larger than MS-2 bacteriophage, in particular against the Bacillus Anthracis.

The connector has a very high seal ensuring a safe airtigth during the use of the filtering system, The face-piece is provided with a sealing lip arranged to act in abutment on the user's face and to adapt to any face shape; this ensures a perfect and safe seal.

The overall system's seal has been assessed by a pneumatic test carried out via a mask-proof apparatus.

The system of the present invention is handy and comfortable thanks to its ligthtness and to its easy use, thanks to the simple way to put it on and, finally, thanks to the rapid way of application and removal of the filter from the mask.

The mask can be put on through the following procedure:

the filter is joined to the mask via the connector, then the mask is tigthtly fastened by means of the straps to the user's face.

The system, besides ensuring an easy use and high comfort, also guarantees the maximum visual field with complete absence of optical distorsions.

The invention claimed is:

1. A filtering system comprising:

A) a protective face mask;

B) a filter against biological agents; and

C) a connector useful to easily, quickly and efficaciously join the filter to the mask, wherein, the filter is a protective filter against biological agents comprising a pleated membrane made of ceramic microfibers, and said membrane is hydrophobic on the worker side, avoiding the penetration of liquid with surface tension >70 dine/cm, and is hydrophilic on the environment side, in order to ensure an high humidification yield.

2. A filtering system as claimed in claim 1 characterized in that said mask comprises a plastic face-piece, a transparent plastic screen, and a sealing lip.

3. A filtering system as claimed in claim 2, characterized in that the plastic face-piece is made of butylic rubber or silicone, the screen is manufactured by polycarbonate and the sealing lip is made of natural rubber.

4. A filtering system as claimed in claim 1 characterized in that it is equipped with buckles for quick fastening.

5. A filtering system as claimed in claim 1, characterized in that the connector comprises a sleeve usable with all breathing systems provided with an EN 148-1 DIN 3183 connector.

6. A filtering system as claimed in claim 1, wherein said membrane is put inside a transparent plastic container, having controlled seal and blunted corners.

7. A filtering system as claimed in claim 6, wherein the plastic material of the container is made of polypropylene, butadiene-styrene or EVA polycarbonatete copolymer.

8. A filtering system as claimed in claim 1 characterized in that the connector consists in a cylinder having, on the mask side, external diameter equal to 40 mm; the external diameter of the filter side is 35.5 mm while the internal diameter is 25.6 (+0.2/−0.0) mm.

9. A filtering system as claimed in claim 8 characterized in that the inside wall of the connector has a circular drill, at 5 mm distance from the edge (filter side), 4 mm wide and 2.4 mm deep, in which an O-ring is inserted with blocking and sealing function.

10. A filtering system as claimed in claim 8 characterized in that the cylinder is made of plastic material.

11. A filtering system as claimed in claim 10 wherein the said plastic material of the cylinder is a polyacetalic copolymer containing glass fibers.

12. A filtering system as claimed in claim 9 characterized in that the O-ring is manufactured by a fluoro or silicone or ethylenepropylene or nitrile based mixture.

13. A method providing protection against biological agents, comprising securing to a user the filtering system of claim 1.

14. The method of claim 13, wherein said biological agents are at least one selected from the group consisting of Hepatitis C Virus (HCV), Hepatitis B Virus (HBV), Human Immunodeficiency Viruses (HIV), Sp. Pseudomonas, Staphylococcus aureus, Serratia Marcescescens and Mycobacterium Tuberculosis.

15. The method of claim 13, wherein said biological agents is the Bacillus Anthracis.

16. A filtering system comprising:

a mask comprising a plastic face-piece;

a transparent plastic screen;

a filter that is a protective filter against biological agents consisting in a pleated membrane made of ceramic microfibers; and a connector comprising a cylinder having, on the mask side, external diameter equal to 40 mm, the external diameter of the filter side being 35.5 mm while the internal diameter is 25.6 (+0.2/−0.0) mm, wherein said membrane is hydrophobic on the worker side, avoiding the penetration of liquid with surface tension >70 dine/cm, and is hydrophilic on the environment side, in order to ensure an high humidification yield.

17. A filtering system comprising:

a protective face mask;

a filter against biological agents; and a connector efficaciously joining the filter to the mask, wherein, the filter is a protective filter against biological agents and comprises a pleated membrane made of ceramic microfibers, and the membrane is hydrophobic on the worker side, avoiding the penetration of liquid with surface tension >70 dine/cm, and is hydrophilic on the environment side.

* * * * *